US005154964A

United States Patent [19]

Iwai et al.

[11] Patent Number: 5,154,964

[45] Date of Patent: Oct. 13, 1992

[54] CORELESS TWIST-TIES

[75] Inventors: Yoshio Iwai; Kazuyuki Takahashi; Takeshi Hirota; Tomoji Abe; Isao Imanishi, all of Osaka, Japan

[73] Assignees: Kyowa Limited, Osaka, Japan; Clements Industries, South Hackensack, N.J.

[21] Appl. No.: 593,213

[22] Filed: Oct. 5, 1990

[30] Foreign Application Priority Data

Oct. 6, 1989 [JP] Japan ..... 1-262773

[51] Int. Cl.[5] ..... B32B 27/00; B65D 77/10

[52] U.S. Cl. ..... 428/156; 428/402; 428/435; 24/30.5 P; 24/30.5 T

[58] Field of Search ..... 24/30.5 T, 30.5 R, 30.5 P, 24/30.5 S, 30.5 L, 30.5 W, 400, 403, 389, 405; 428/402, 406, 435, 156; 521/154

[56] References Cited

U.S. PATENT DOCUMENTS 3,290,854 12/1966 MacMurray ..... 24/30.5 T
3,535,746 10/1970 Thomas, Jr. ..... 24/30.5 TC
3,604,066 9/1971 Moon ..... 24/30.5 R
3,857,139 12/1974 Turner ..... 24/30.5 T
3,945,086 3/1976 Hoard ..... 24/30.5 T
3,962,524 6/1976 Miyamoto et al. ..... 428/435
4,113,915 9/1978 Schott ..... 428/402
4,797,313 1/1989 Stolk et al. ..... 24/30.5 T

*Primary Examiner*—Victor N. Sakran
*Attorney, Agent, or Firm*—Blum Kaplan

[57] ABSTRACT

A non-metallic coreless twist-tie is formed by melting polymeric material, extruding the material in an elongated form, cooling the material, than drawing the material at a rate of more than about 2.5 times. The tie can include glass beads. The polymer is preferably formed from polymeric resin having a degree of crystallization of about 10% to 60% at a crystallized temperature range of about 100° C. to 250° C. and can also include a quantity of fine glass beads. The resulting tie can be twisted and untwisted many times without breakage, is suitable for use in microwave ovens and is simpler to construct than multicomponent ties.

21 Claims, 1 Drawing Sheet

FIG.1
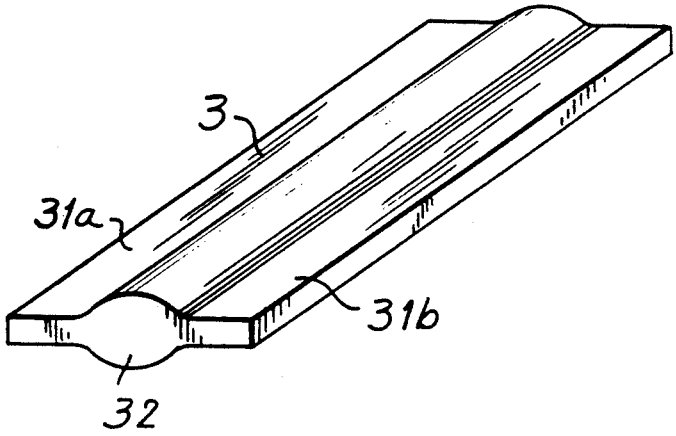
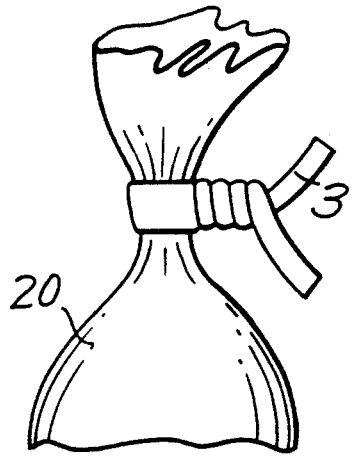
FIG.2
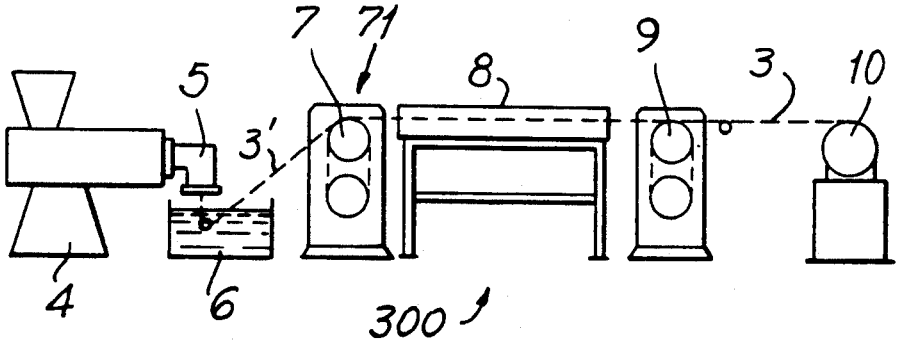
FIG.3
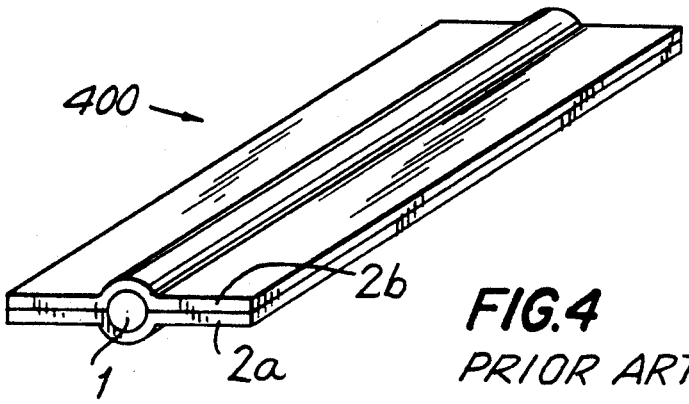
FIG.4
PRIOR ART

CORELESS TWIST-TIES

BACKGROUND OF THE INVENTION

The invention relates generally to a twist-tie and more particularly to a non-metallic closure device that can be mechanically twisted to releasably seal containers, including those that are heated in a microwave oven.

Conventional twist-ties are formed with a wire core enclosed in either a plastic or a paper ribbon. These ties are useful because they can seal bags and other containers by hand or machine and the bags can be opened and resealed easily. The metal core tie does not retain memory for any prior shape and will retain the configuration to which it is deformed. Metal core twist-ties are also beneficial because the tie can be twisted and untwisted many times into many different configurations without breakage.

A conventional metal-core twist-tie 400 is shown in FIG. 4. Twist-tie 400 is formed by coating a wire core 1 with a pair of plastic films 2*a* and 2*b*. An example of twist-tie 400 is sold under the trade name VINYL-TIES. Plastic ties and paper ties which are formed by covering a core material with a film such as PVC, PET, polyethylene or paper are also common. Another plastic wire tie is described in Japanese Utility Model Publication No. 190654/85.

Metal core twist-ties also suffer from drawbacks. The metal core can protrude from the coating and can injure a user or puncture the container the tie is intended to seal. The metal can rust when exposed to moisture or corrosive materials. Metal closures are also inappropriate for sealing food containers that are intended to be heated in microwave ovens or which are passed through metal detectors.

There have been several attempts to produce non-metallic twist-ties that possess the advantages of a metal core twist-tie without the associated disadvantages. However, such metal-free twist-ties have not proved to be fully satisfactory.

Japanese Application No. 59-79252, filed May 29, 1984, describes a twist-tie formed with a polymeric core disposed between two polymeric tape ribbons. However, it is disadvantageous to form a three piece tie because separation can occur between the core and the ribbon laminate. Furthermore, the properties of the twist-ties formed in accordance with that application were not sufficiently suitable for a wide range of uses. Ties having a core adhered to laminate strips have drawbacks. The laminate must be adhered to the core and this complicates the manufacturing process. The core can separate from the covering and puncture containers or injure a user.

Another non-metallic polymeric twist-tie is described in U.S. Pat. application No. 4,797,313 dated Jan. 10, 1989. That application describes the benefits of including particulate rubber impact modifiers and polymeric material having glass/rubber transitional behavior at a temperature range of about 10° to 40° C. exhibiting yield at a stress between about 500 and 9,000 psi at a strain rate between 0.1 and 0.5 inches per inch per minute. However, such a twist-tie has also been found to be not fully suitable for certain applications.

Accordingly, it is desirable to develop an improved twist-tie which avoids the shortcomings of the prior art.

SUMMARY OF THE INVENTION

Generally speaking, in accordance with the invention, a non-metallic twist-tie and method of forming the twist-tie are provided. The tie is formed with crystalline thermoplastic synthetic resin that is melt extruded in an elongated form, then drawn at a draw rate of 2.5 or more times to form a length twist-tie material. A preferred embodiment is formed of PET and olefin and can include glass beads. In a stress-strain curve, the yield point temperature of the polymer material is preferably between about −30° C. and 100° C. For the resulting ties, this temperature is between about −25° C. and 70° C. The resulting ties can be placed in microwave ovens.

Accordingly, it is an object of the invention to provide an improved coreless twist-tie and method of forming a coreless tie.

Another object of the invention is to provide a twist-tie that can be subjected to microwave radiation ovens.

A further object of the invention is to provide a durable non-metallic twist-tie.

Still other objects and advantages of the invention will in part be obvious and will in part be apparent from the specification and drawings.

The invention accordingly comprises the several steps and the relation of one or more of such steps with respect to each of the others, and the article possessing the features, properties, and the relation of elements, which are exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a perspective view of a non-metallic twist-tie constructed in with the invention;

FIG. 2 is a perspective view of the twist-tie of FIG. 1, in use;

FIG. 3 is a schematic view of an apparatus for forming the twist-tie of FIG. 1; and FIG. 4 is a perspective view of a conventional twist-tie.

DETAILED DESCRIPTION OF THE PREFERRED EMBODIMENTS

The non-metallic twist-ties of the invention help solve problems associated with ties having a three piece laminated structure. Twist-ties formed in accordance with the invention are preferably formed from crystalline thermoplastic synthetic resin and optionally, fine glass beads, preferably having a particle size of 60 μm or less. The resin preferably includes one or more of the following components: super high molecular polyethylene resin, polypropylene resin, polyamide resin, polybutylene terephthalate (PBT) resin, polyethylene terephthalate (PET) resin and the like. The resin preferably also includes lubricants such as zinc stearate, plasticizers such as phthalates, adipates or polyesters and, if desired, accelerators for crystallization and pigment.

A melt of at least one of these resins is extruded in a strip form and then drawn at a draw ratio of about 2.5 times or more. The resulting strip is preferably formed to have a width of about 2.5 mm or more.

Ties in accordance with the invention are formed to fulfill the following desirable qualities of twist-ties.

1. The tie can be twisted easily either by hand or by a binding jig;

2. After twisting, the twisted portion does not loosen on its own;

3. The twisted portion can be readily undone without breakage;

4. The tied articles are not damaged by the tie;

5. The tie will not typically injure users;

6. Printed messages such as the manufacturers name or location, the article name, the lot number or freshness date can be imprinted onto the tie; and 7. The ties can be colored to provide a distinguishing function.

A coreless twist-tie 3 is shown in FIG. 1. Twist-tie 3 differs from twist-tie 400. Twist-tie 3 is formed with a thickened central portion 32 having a pair of wing portions 31*a* and 31*b* on both sides of central portion 32. Wing portions 31*a* and 31*b* are formed of the same material as central portion 32. Tie 3 can be used to seal a bag 20, as shown in FIG. 2.

In order for tie 3 to have the properties of twisting, tying and untying described above, tie 3 must have suitable rigidity (elasticity) and high plasticity. To increase plasticity, non-directional filler can be added to the resin before it is extruded and drawn. Examples of non-directional filler that increase the plasticity of the tie include calcium carbonate, clay, white carbon, titanium white, barium sulfate and zinc white. However, it is difficult to extrude such an article into a uniform thin strip. Furthermore, although such an article has high plasticity and retains a twisted shape well, such an article has unacceptable strength and rigidity and is too prone to breakage and cracking.

Extruded resins that do not contain fillers have high strength, rigidity and elasticity but do not maintain a twisted shape. As a result, such articles become untied on their own and were unsatisfactory as twist ties.

Glass fibers have also been included in extruded and drawn polymeric ribbons in an attempt to increase the mechanical strength and bending resistance of the polymer. However, the drawn article exhibited acceptable rigidity and strength due to orientation of the glass fibers from the drawing process. Such ties were too hard for most applications and could be too difficult to twist by hand. Once twisted, these articles tended to return to the untwisted state on their own. A composition including both glass fibers and filler presented unsatisfactory difficulties in both melting and extruding.

It has been found that the addition of glass beads to the polymer has certain beneficial effects. Melter polymer is combined with glass beads and then extruded and drawn to form a tie. The resulting tie has the properties of flexibility to permit easy twisting and untwisting as well as sufficient plasticity to maintain the tie in the twisted condition.

An especially preferred tie is formed from crystalline thermoplastic synthetic resin having 10 to 60% degree of crystallization in a crystallized temperature range of about 100° C. to 250° C. Such resin provides excellent strength, rigidity and tying properties. The resin is formed of at least one of the following: super high polymer polyethylene resin, polypropylene resin, polyamide resin, polybutylene terephthalate resin (PBT), polyethylene terephthalate (PET) resin and the like and should have a tensile strength of about 500 kg/cm$^2$ or more when combined with glass beads. At a crystallized temperature of 120° to 220° C., PET should have 15 to 25% degree of crystallization. At 150° to 200° C., PBT should have 30%. Resins having a tensile strength of 500 kg/cm$^2$ or less tended to have insufficient strength.

Ties formed of non-crystalline resins, including those having high draw rate, did not provide as acceptable strength and rigidity due to the orientation of the polymer. Accordingly, these ties were not as suitable for most applications. Furthermore, polymers having more than about 60% degree of crystallization had increased strength, rigidity and elasticity but lacked sufficient impact strength. The resulting ties were more fragile and did not have as satisfactory tying and untying properties.

The size of the glass beads in the tie were found to affect the properties of the tie. When the glass beads had a particle size of more than about 60 μm, the molding obtained was found to have increased plasticity as in the case of using nondirectional filler. However, the strength was reduced. It is believed that large glass beads are not oriented properly during the drawing step so that the molding was longitudinally void around the glass beads to yield a porous state. It is believed that the use of beads larger than about 60 μm lead to this porous state which reduces the strength of the tie. Pores were substantially not observed in ties formed with glass beads having a particle size of less than 60 μm. If pores were observed, they were sufficiently small and did not interfere with the desirable physical qualities.

It is preferable to include glass beads in a ratio of 3 to 50 parts by weight glass beads to 100 parts by weight polymer. When the percentage of glass beads is too high, the resulting tie is too hard which reduces twisting strength. If the percentage of glass beads is too low, the beads will not sufficiently increase the plasticity of the ties.

To increase the compatibility of the glass beads to the polymer, it is preferable to add a small amount of plasticizer to the polymer before the beads are added. It is also preferable to lubricate the beads before they are added to the polymer such as by adsorbing a lubricant such as zinc stearate on the beads. It can also be advantageous to include glass beads that are surface treated with silane coupling agent or epoxy resin.

A draw ratio of 2.5 times or more is preferable. When employing certain resins, the desired ratio could be attained by employing a primary drawing followed by a secondary drawing. When draw ratios of less than about 2.5 times were employed, the resulting ties had insufficient rigidity to successfully provide the binding function and had insufficient twist ability.

Ties of different cross-sectional shapes were formed. Strip-like ties, including tie 3 having a thickened central portion 32 and two wing portions 31*a* and 31*b* tended to have good tie properties. Ties having circular cross-sections tended to untie on their own compared to the strip-like tie. The circular ties had enhanced slidableness of the plastic components and had increased incidence of puncturing the tied article. It is also more difficult to print a message on a circular tie.

FIG. 3 is a schematic view of an apparatus 300 for forming twist-tie 3. Apparatus 300 includes an extruder for having a 6-point thermoregulation disk. Extruder 4 includes an extruding outlet 5 having a gear pump. A strip of extruded material 3' exits outlet 5 and enters a cooling bath 6.

Extruded material 3' is then wound around a first takeup drum 7 of a drawing device 71 and then passes through a drawing bath 8 which has a temperature that is lower than the melting temperature of the resin but higher than the cooling temperature. Extruded material 3' is then wound around a second takeup drum 9. Extruded 3' is drawn to a desired draw ratio by the difference in speed between first takeup drum 7 and second takeup drum 9 to yield coreless twist-tie 3 which is wound by a takeup machine 10.

It is also beneficial to pass coreless twist-tie 3 through a hot water bath after it comes off second take-up drum 9. As tie 3 leaves the hot water bath, it can be passed through an air blowing zone.

The appropriate extruding temperature depends on the melting point of the resin that is employed. For example, polyamide resin and polyphthalate resin should be extruded at temperatures above 260° C., polybutylene terephthalate resin should be extruded at a temperature of about 240° C. and polyethylene and polypropylene should be extruded at temperatures above about 180° C. The cooling temperature should be about 100° C. or less; the drawing temperature should be about 150° to 80° C.; the hot water bath should be at about 98° C. to 100° C.; the air blowing zone should be at about 25° C.; and the draw ratio should be more than about 2.5 times, more preferably 2.5 to 3.5 times.

EXAMPLE 1

A tie having the following configuration was found to have excellent properties:

0.3 mm or less wing portion thickness;

0.5 mm to 2.0 mm raised middle portion diameter; and 2.5 mm or more width.

Ties having a width of less than 2.5 mm tended to cut into the tied article. The ratio of the diameter of the central portion to the overall tie width should be from about 1:5 to 1:1.25, more preferably between 1:3 and 1:4.5. The ratio of the thickness of the wings to the overall width should be between about 1:8 to 1:35, more preferably 1:20 to 1:30.

EXAMPLE 2

The compositions listed in Table 1 were melted and extruded, then drawn three times long to obtain 5 mm wide coreless twist-ties. For comparison, a rod-like article having a 5 mm diameter was also prepared. The properties of the articles produced in compositions 1–4 are summarized in Table 2. Composition 5 exhibited results similar to Composition 2.

TABLE 1

| | Composition 1 | Composition 2 | Composition 3 | Composition 4 | Composition 5 |
|---|---|---|---|---|---|
| A polyethylene terephthalate resin | 100 | 90 | — | — | 100 |
| B Polyamide resin | — | — | 100 | — | — |
| C Polypropylene resin | — | — | — | 100 | 5 |
| D Polybutylene terephthalate resin | — | 10 | — | — | 10 |
| E Zinc stearate | 0.10 | 0.10 | 0.10 | 0.10 | 0.10 |
| F DOP | 1.00 | 1.00 | 1.00 | 1.00 | 1.00 |
| G Adecapole CLE-1000 | 0.01 | 0.01 | 0.01 | 0.01 | 0.01 |
| H Glass beads | 15.00 | 30.00 | 20.00 | 15.00 | 0 |
| I Pigment (phthalocyanin blue) | 0.05 | 0.05 | 0.05 | 0.05 | 0.05 |

The manufactures of the products above are as follows.

| | |
|---|---|
| A Polyethylene terephthalate resin | Yunichika K. K. |
| B Polyamide resin | Yunichika K. K. |
| C Polypropylene resin | Mitsui Sekyu Kagaku K. K. |
| D Polybutylene terephthalate resin | Toray K. K. |
| E Zinc stearate | Sakay Kagaku Kagaku K. K. |
| F DOP | Dainippon Ink Kaga Ku Kogyo K. K. |
| G Adecapole CLE-1000 | Asahidenka Kogyo K. K. |
| H Glass beads | Kabushiki Kaisha Union |
| I Pigment (phthalocyanic blue) | Sanyo Shikiso K. K. |

TABLE 2

| | Characteristic properties | | | | | | | | |
|---|---|---|---|---|---|---|---|---|---|
| | Composition 1 | | Composition 2 | | Composition 3 | | Composition 4 | | Note |
| Shape | strip | rod | strip | rod | strip | rod | strip | rod | cored strip |
| Capability | | | | | | | | | |
| Easy of twisting | easy | easy | easy | easy | easy | easy | easy | easy | easy |
| Capability of keeping twist | good | bad | good | bad | good | bad | good | bad | good |
| Capability of untwisting | unbreakable | unbreakable | easy | unbreakable | unbreakable | unbreakable | unbreakable | unbreakable | unbreakable |
| Cutting into tied article (Chinese cabbage) by tying | nil | nil | nil | yes | nil | yes | nil | yes | yes |
| Safe in twisting (fingers are free from injury) | nil | nil | nil | nil | nil | nil | nil | nil | yes |
| Easy of printing for indication of contents | easy | hard | easy | hard | easy | hard | easy | hard | easy |

Note: conventional twist-tie made of 8-carbon steel wire core 0.5 mm in diameter.

As shown above, coreless twist-ties formed in a strip configuration satisfied the functions of a twist-tie.

EXAMPLE 3

Twist-ties were formed with a mixture of PET polymer and olefin polymer both alone and with the addition of glass beads. The PET employed had a glass transition temperature of 70° C. and glass/rubber transitional behavior in the range of about 80° C. and 130° C. The resulting tie exhibited yield at a stress between about 9,000 and 10,000 psi.

The tie was formed of PET/polypropylene/polybutylene terephthalate at a ratio of 100/5/10. The properties of this tie, compared to properties of a standard PVC tie, are listed below in Table 3.

TABLE 3

| PROPERTIES | Tie of the Invention | Standard PVC ties | Conditions |
|---|---|---|---|
| 1. Tensile Strength | 850 | 600 | Pulling speed |

TABLE 3-continued

| PROPERTIES | Tie of the Invention | Standard PVC ties | Conditions |
|---|---|---|---|
| (Kg/cm$^2$) | | | 50 mm/min |
| 2. Elongation (%) | 150 | 15 | pulling speed 50 mm/min |
| 3. Anti-acidity | no change | 150% swelling | 5% acetic acid |
| 4. Anti-alkali | resolve | 10% swelling | 28% ammonia water dipped for 5 days |
| 5. Anti-oil Mineral Oil | no change | 5% swelling | kerosene 5 days |
| Vegetable Oil | no change | 5% swelling | soybean oil 5 days |
| 6. Anti-salt water | no change | 10% swelling | 10% solution of salt 5 days |
| 7. Fading color | no change | a little | outdoor exposure 2 months |
| 8. Shrinkage at heat | 5% | 0% | 98° C. boiled water |
| 9. Usable temperature | 0–60° C. and higher | 0–60° C. | |

EXAMPLE 4

A twist-tie having the composition set forth in Example 3 was formed with the following dimensions and was found to be extremely well suited for functioning as a twist-tie.

Core diameter (center of the tie): 0.95±0.05 mm

Width: 3.8±0.2 mm

Thickness of wing: 0.15±0.02 mm

As described above, a preferred embodiment of a coreless twist-tie has a composition formed mainly of crystalline thermoplastic synthetic resin and optionally fine glass beads of 60 μm or less in particle size. The resin includes one or more of super high molecular polyethylene resin, polyamide resin, polybutylene terephthalate resin, polyamide resin, polybutylene terephthalate resin, polyethylene terephthalate resin and the like. The resin is melt extruded in a strip form, then drawn at a draw rate of 2.5 or more times and formed into a strip.

The resin is melt extruded at an extrusion temperature of 260° C. or more when polyamide resin or polyethylene terephthalate resin is used, at 240° or more when polybutylene terephthalate resin is used, and at 180° C. or more when polyethylene or polypropylene resin is used. The composition is melt extruded in strips under conditions of extrusion depending upon the melting points of the resins, and is thereafter preferably formed in a strip of 2.5 mm or more in width at a cooling temperature of 100° C. or less at a drawing temperature of 150° to 80° C., and at a draw ratio of 2.5 or more times.

It will thus be seen that the objects set forth above, among those made apparent from the preceding description, are efficiently attained and, since certain changes may be made in carrying out the above method and in the article set forth without departing from the spirit and scope of the invention, it is intended that all matter contained in the above description and shown in the accompanying drawings shall be interpreted as illustrative and not in a limiting sense.

It is also to be understood that the following claims ar intended to cover all of the generic and specific features of the invention herein described and all statements of the scope of the invention which, as a matter of language, might be said to fall therebetween.

Particularly it is to be understood that in said claims, ingredients or compounds recited in the singular are intended to include compatible mixtures of such ingredients wherever the sense permits.

What is claimed is:

1. A wireless twist-tie having a uniform cross-section adapted to be deformed from a ribbon into a releasable closure, comprising polymeric material extruded from polymeric resin having about 10 to 60% degree of crystallization in a crystallized temperature range of about 100° C. to 250° C. and drawn at a draw ratio of more than about 2.5 times.

2. The twist-tie of claim 1, including glass beads.

3. The twist-tie of claim 2, wherein the glass beads have a particle size of less than about 60 μm.

4. The twist-tie of claim 2, wherein the twist-tie includes about 3 to 50 parts by weight glass beads to 100 parts by weight polymer.

5. The twist-tie of claim 4, wherein the glass beads have a particle size of less than about 60 μm.

6. The twist-tie of claim 1, wherein the polymeric resin includes PET resin and olefin resin.

7. The twist-tie of claim 1, wherein the polymeric resin includes PET resin, polypropylene resin and polybutylene terephthalate resin.

8. The twist-tie of claim 7, wherein the ratio of PET to polypropylene to polybutylene terephthalate is about 100:5:10.

9. The twist-tie of claim 1, including lubricants, crystallization accelerators and plasticizers.

10. The twist-tie of claim 1, wherein the draw ratio is between about 2.5 and 3.5.

11. The twist-tie of claim 1, wherein the draw ratio is about 3.

12. The twist-tie of claim 1, wherein the resin is selected from the group consisting of polyethylene resin, polypropylene resin, polyamide resin, polybuthylene terephthalate resin, polyethylene terephthalate and combinations thereof.

13. The twist-tie of claim 1, wherein the twist-tie is formed with a thickened central portion having two wings extending from the central portion in which the ratio of the overall width to the thickness at the central portion is between about 3:1 and 4.5:1 and the ratio of the overall width to the thickness of the wings is between about 20:1 to 30:1.

14. A method of forming a twist-tie having a uniform cross-section adapted to be repeatedly deformed from a ribbon into a releasable closure, from melted polymeric material having a degree of crystallization between about 10% and 60% in a crystallized temperature range of about 100° C. to 250° C., comprising:

extruding a ribbon from melted polymer resin having a degree of crystallization between about 25% and 60%;

cooling the extruded ribbon;

drawing the ribbon at a ratio of more than about 2.5 times.

15. The method of forming a twist-tie of claim 14, wherein the melted polymer resin includes glass beads.

16. The method of forming a twist-tie of claim 14, wherein the extruded ribbon is cooled to a temperature of less than about 100° and drawn at a temperature between about 80° C. and 150° C.

17. The method of forming a twist-tie of claim 14, wherein the draw ratio is between about 2.5 and 3.5.

18. The method of forming a twist-tie of claim 14, wherein after the ribbon is drawn, it is passed through a heated fluid bath and then cooled by air.

19. The method of forming a twist-tie of claim 14, wherein the fluid bath is at a temperature of about 100° C.

20. A method of forming a wireless twist-tie adapted to be repeatedly deformed from a ribbon into a releasable twisted closure, comprising the steps of:

providing a melt of polymeric material;

extruding a ribbon of polymeric material from the melted polymeric material;

cooling the ribbon to a temperature below 100° C.; and drawing the extruded ribbon at a ratio of more than about 2.5 times and at a temperature between about 80° C. and 150° C.

21. The method of forming a wireless twist-tie of claim 20, wherein the polymeric material is selected from the group consisting of PET, polyethylene, polypropylene, polyamide, polybutylene terephthalate and combinations thereof.

* * * * *